US005382219A

United States Patent [19]

Malekmadani

[11] Patent Number: 5,382,219

[45] Date of Patent: Jan. 17, 1995

[54] ULTRA-LIGHT COMPOSITE CENTRIFUGE ROTOR

[75] Inventor: Mohammad G. Malekmadani, Cupertino, Calif.

[73] Assignee: Composite Rotor, Inc., Santa Clara, Calif.

[21] Appl. No.: 202,676

[22] Filed: Feb. 25, 1994

Related U.S. Application Data

[63] Continuation of Ser. No. 4,684, Jan. 14, 1993, abandoned.

[51] Int. Cl.[6] ..... B04B 5/02; B04B 7/08

[52] U.S. Cl. ..... 494/16; 494/81; 74/572

[58] Field of Search ..... 494/12, 16, 19, 20, 494/31, 33, 43, 44, 81, 85; 422/72; 74/572, 573 R, 574

[56] References Cited

U.S. PATENT DOCUMENTS

| | | | |
|---|---|---|---|
| 3,248,046 | 4/1966 | Feltman, Jr. et al. . | |
| 3,720,368 | 3/1973 | Allen | 494/16 |
| 3,788,162 | 1/1974 | Rabenhorst et al. | 74/572 |
| 3,825,178 | 7/1974 | Burg | 494/16 |
| 3,913,828 | 10/1975 | Roy | 494/81 |
| 4,207,778 | 6/1980 | Hatch | 74/572 |
| 4,226,669 | 10/1980 | Vilardi | 494/16 X |
| 4,266,442 | 5/1981 | Zorzi | 74/572 |
| 4,413,860 | 11/1983 | Prescott . | |
| 4,449,965 | 5/1984 | Strain | 494/16 |
| 4,464,161 | 8/1984 | Uchida et al. | 494/12 X |
| 4,468,269 | 8/1984 | Carey | 156/175 |
| 4,484,906 | 11/1984 | Strain | 494/16 |
| 4,701,157 | 10/1987 | Potter | 494/81 X |
| 4,738,656 | 4/1988 | Piramoon et al. | 494/81 |
| 4,781,669 | 11/1988 | Piramoon | 494/81 X |
| 4,790,808 | 12/1988 | Piramoon | 494/81 |
| 4,817,453 | 4/1989 | Breslich, Jr. et al. | 74/572 |
| 4,822,331 | 4/1989 | Taylor | 494/16 |
| 4,824,429 | 4/1989 | Keunen et al. | 494/81 X |
| 4,832,679 | 5/1989 | Bader | 494/16 |
| 4,860,610 | 8/1989 | Popper et al. | 74/572 |
| 4,991,462 | 2/1991 | Breslich, Jr. et al. | 74/572 |
| 5,057,071 | 10/1991 | Piramoon | 494/16 |

FOREIGN PATENT DOCUMENTS

| | | | |
|---|---|---|---|
| 969780 | 6/1975 | Canada | 74/615 |
| WO93/08675 | 4/1993 | European Pat. Off. . | |
| 600884 | 8/1934 | Germany | 494/16 |
| 2453650 | 5/1975 | Germany | 494/81 |
| 3334655 | 4/1985 | Germany | 494/16 |
| 48-30431 | 9/1973 | Japan | 494/81 |
| 49-38671 | 10/1974 | Japan | 494/81 |
| 54-21477 | 2/1979 | Japan | 74/572 |
| 2097297 | 11/1982 | United Kingdom | 494/16 |
| 2098516 | 11/1982 | United Kingdom | 494/16 |

OTHER PUBLICATIONS

"Advanced Centrifuge Rotors", published by KOMP-spin Technologies, Inc., Apr. 1991.

"Instructions For Using The VC53 Vertical Tube Rotor", published by Spinco Division of Beckman Instruments, Inc., Mar. 1988.

A one-page brochure on Savant HSC15R Refrigerated Microcentrifuge, date unknown.

*Primary Examiner*—Stephen F. Gerrity
*Assistant Examiner*—Charles Cooley
*Attorney, Agent, or Firm*—Limbach & Limbach

[57] ABSTRACT

A fixed-angle centrifuge rotor fabricated from fiber-reinforced composite material including a composite rotor plate, composite tube holders, and a hub to attach the rotor plate to a centrifuge. The rotor plate has counterbored through holes with each counterbore defining an annular step. The tube holders are cylindrical in shape and are mounted to the rotor plate in each of the counterbored through holes. Each tube holder has an circumferential flange that mates with and is bonded to the annular step in a counterbore of the rotor plate.

9 Claims, 9 Drawing Sheets

ULTRA-LIGHT COMPOSITE CENTRIFUGE ROTOR

This is a continuation of co-pending application Ser. No. 08/004,684 filed on Jan. 14, 1993 now abandoned.

SUMMARY OF THE INVENTION

1. Field of the Invention

This invention relates generally to centrifuge rotors, and relates more particularly to a rotor fabricated and reinforced with composite materials.

2. Description of the Relevant Art

Centrifuges are commonly used in medical and biological research for separating and purifying materials of differing densities, such as viruses, bacteria, cells, protein, and other compositions. A centrifuge includes a rotor typically capable of spinning at tens of thousands of revolutions per minute.

A preparative centrifuge rotor has some means for accepting tubes or bottles containing the samples to be centrifuged. Preparative rotors are commonly classified according to the orientation of the sample tubes or bottles. Vertical tube rotors carry the sample tubes or bottles in a vertical orientation, parallel to the vertical rotor axis. Fixed-angle rotors carry the sample tubes or bottles at an angle inclined with respect to the rotor axis, with the bottoms of the sample tubes being inclined away from the rotor axis so that centrifugal force during centrifugation forces the sample toward the bottom of the sample tube or bottle. Swinging bucket rotors have pivoting tube carriers that are upright when the rotor is stopped and that pivot the bottoms of the tubes outward under centrifugal force.

Many centrifuge rotors are fabricated from metal. Since weight is concern, titanium and aluminum are commonly used materials for metal centrifuge rotors.

Fiber-reinforced, composite structures have also been used for centrifuge rotors. Composite centrifuge rotors are typically made from laminated layers of carbon fibers embedded in an epoxy resin matrix. The fibers are arranged in multiple layers extending in varying directions at right angles to the rotor axis. During fabrication of such a rotor, the carbon fibers and resin matrix are cured under high pressure and temperature to produce a very strong but lightweight rotor. U.S. Pat. Nos. 4,781,669 and 4,790,808 are examples of this type of construction. Sometimes, fiber-reinforced composite rotors are wrapped circumferentially with an additional fiber-reinforced composite layer to increase the hoop strength of the rotor. See, for example, U.S. Pat. Nos. 3,913,828 and 4,468,269.

Composite centrifuge rotors are stronger and lighter than equivalent metal rotors, being perhaps 60% lighter than titanium and 40% lighter than aluminum rotors of equivalent size. The lighter weight of a composite rotor translates into a much smaller mass moment of inertia than that of a comparable metal rotor. The smaller moment of inertia of a composite rotor reduces acceleration and deceleration times of a centrifugation process, thereby resulting in quicker centrifugation runs. In addition, a composite rotor reduces the loads on the centrifugal drive unit as compared to an equivalent metal rotor, so that the motor driving the centrifuge will last longer. Composite rotors also have the advantage of lower kinetic energy than metal rotors due to the smaller mass moment of inertia for the same rotational speed, which reduces centrifuge damage in case of rotor failure. The materials used in composite rotors are resistent to corrosion against many solvents used in centrifugation. In a fixed-angle centrifuge rotor, several cell holes are machined or formed into the rotor at an angle of 5 to 45 degrees, typically, with respect to the rotor axis. The cell holes receive the sample tubes or bottles containing the samples to be centrifuged. Cell holes can be either through holes that extend through the bottom of the rotor, or blind holes that do not extend through the bottom. Through cell holes are easier to machine than blind cell holes, but require the use of sample tube holders inserted into the cell holes to receive and support the sample tubes.

SUMMARY OF THE INVENTION

In accordance with the illustrated preferred embodiment, the present invention provides a centrifuge rotor having a composite rotor plate, composite tube holders, composite bottom and top covers, and a hub to attach the rotor plate to a centrifuge. The rotor plate has counterbored through holes with each counterbore defining an annular step. The holes are equally spaced in an annular array adjacent to the plate periphery. The tube holders are cylindrical in shape and are mounted to the rotor plate in each of the counterbored through holes. Each tube holder has an circumferential flange that mates with and is bonded to the annular step in a counterbore of the rotor plate. Each tube holder has an open top for receiving a sample tube and a closed bottom for supporting the sample tube. The bottom cover is an axi-symmetrical shell structure that mounts on the rotor plate and covers the bottoms of the tube holders.

The present invention uses only composite materials in a hollow structure and thus has the advantages of ultra-light weight, Low energy, and corrosion resistance.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1 through 9 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
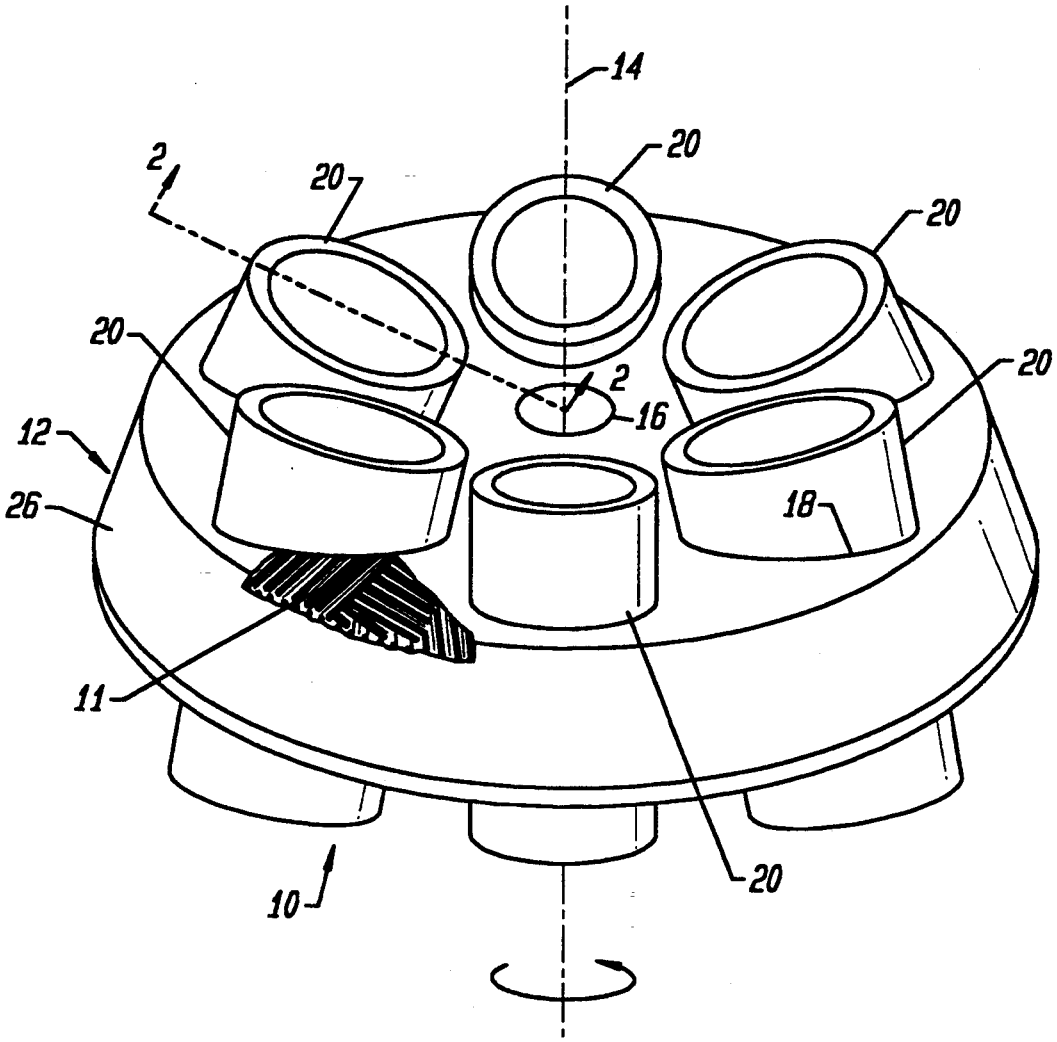
FIG. 1 is a perspective view of a fixed-angle centrifuge rotor according to the present invention. Bottom and top covers are hoe shown.
Figure 2:
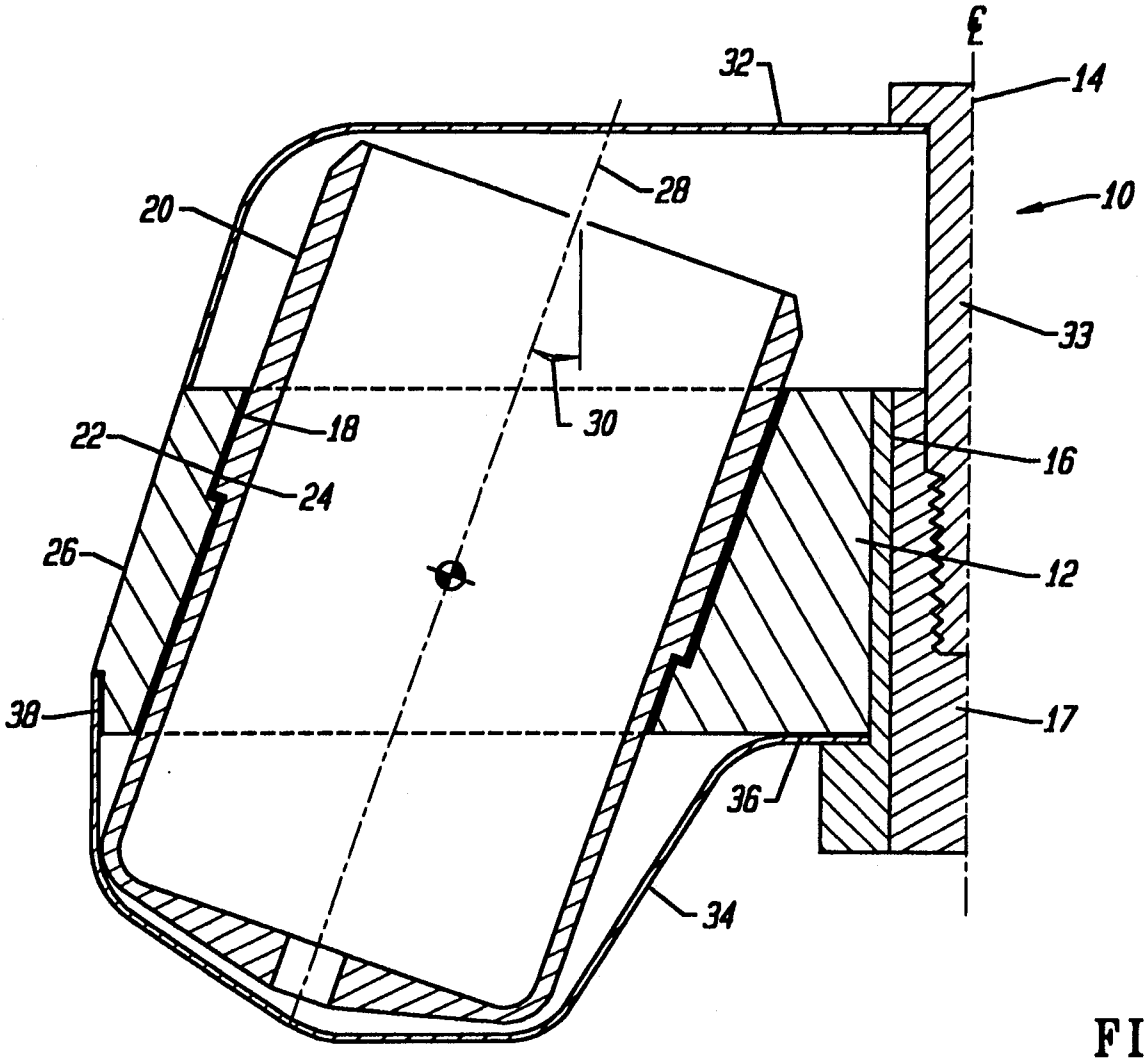
FIG. 2 is a sectional view of the centrifuge rotor of FIG. 1.

The preferred embodiment of the present invention is a fixed-angle centrifuge rotor 10 fabricated from fiber-reinforced composite materials, as shown in FIGS. 1 and 2. The rotor 210 has a rotor plate 12 composed of multiple layers 11 of resin-coated carbon fibers which are indexed to a predetermined repeating angle. The fiber layers of the rotor plate 12 are oriented at right angles to the axis of rotation 14 of the rotor 10 to provide the optimum strength against centrifugal forces generated when the rotor is rotating. The rotor 10 includes a hub 16 that mounts to a spindle 17 (FIG. 2) of a centrifuge machine (not shown), which spins the rotor about its axis 14. The rotor plate 12 has six counterbored through holes 18, each angled toward the rotor axis 14 and each containing a tube holder 20. Each counterbored hole 18 has an annular step 22 (FIG. 2) that supports a circumferential flange 24 on the tube holder 20. The radially outer surface 26 of the rotor plate 12 is conical in shape.

In the illustrated embodiment, the rotor plate 12 includes six tube holders 20, each oriented with its axis 28 intersecting the rotor axis 14 at an oblique angle 30. All of the tube holders are preferably oriented at the same oblique angle with respect to the rotor axis, although this is not necessary. For symmetry, however, it is preferred that opposite tube holders be oriented at the same oblique angle. Each tube holder 20 receives a sample tube or bottle (not shown) containing the materials to be centrifuged. The rotor 10 need not have six tube holders, but it should have an even number of tube holders symmetrically arranged in an annular pattern.

FIG. 2 shows that the rotor 10 has a top axi-symmetric cover 32 and a bottom axi-symmetric cover 34, both to reduce the aerodynamic drag of the rotor 10. The bottom cover 34 covers the lower portions of the tube holders 20 that protrude below the bottom of the rotor plate 12. The bottom cover 34 is preferably bonded to an inner bottom surface 36 of the rotor plate 12 and to an outer edge 38 of the rotor plate. The top cover 32 is removable, and covers the upper portions of the tube holders 20 that protrude above the top of the rotor plate 12. The top cover 32 is screwed to spindle 17 of the centrifuge by a bolt 33. The top and bottom covers are preferably fabricated from a carbon fiber-reinforced composite material.

The center of gravity of the tube holder 20 is positioned between the upper and lower surfaces of the rotor plate 12 so that the centrifugal loading of the tube holder on the rotor plate is in the plane of the rotor plate. Preferably, the thickness of the rotor plate 12 is about one-third of the height of the tube holder 20, and about one-third of the tube holder protrudes below the rotor plate and a similar amount protrudes above tile rotor plate.

Figure 3:
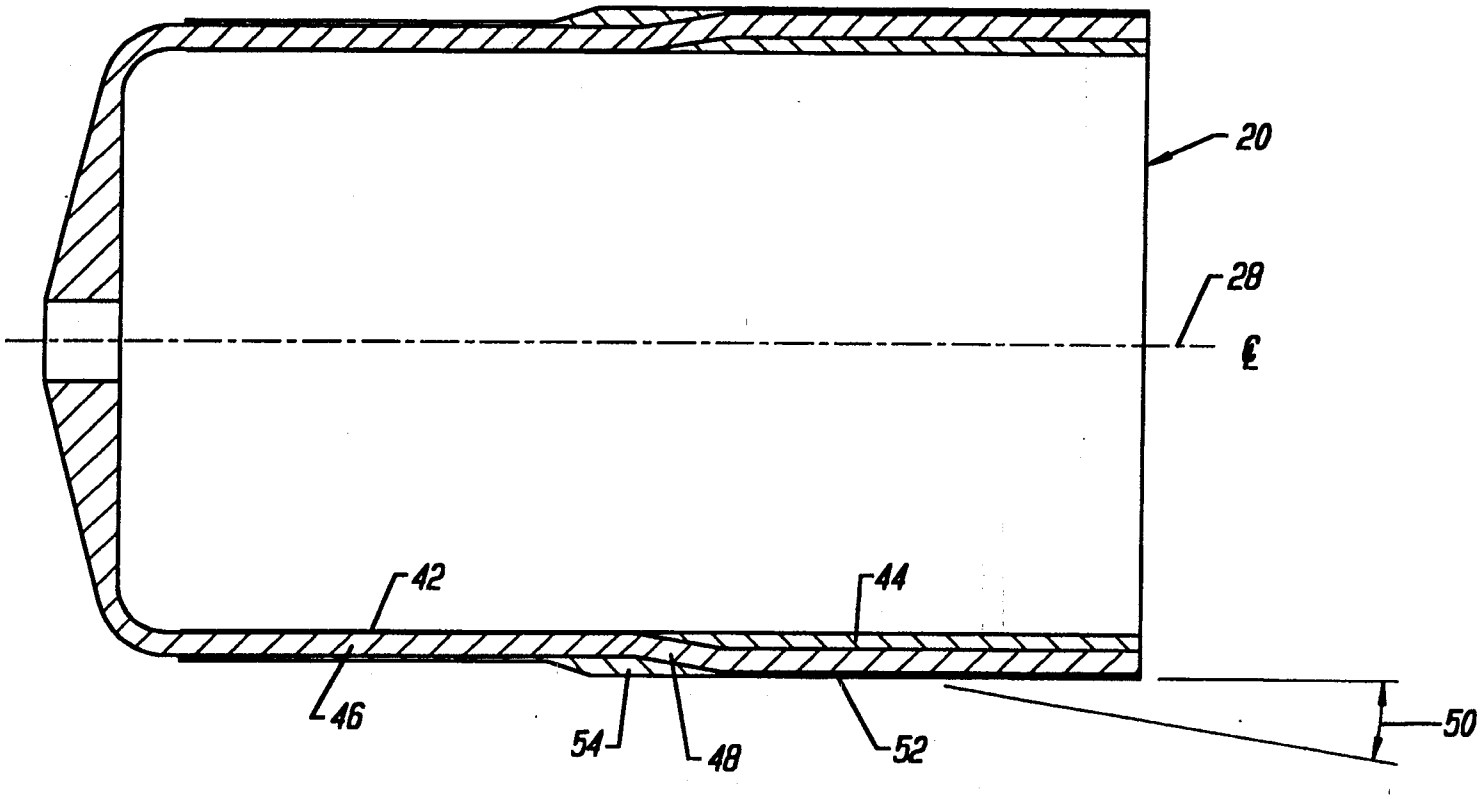
FIG. 3 is a sectional view of a filament-wound tube holder during a preliminary stage in its fabrication.
Figure 4:
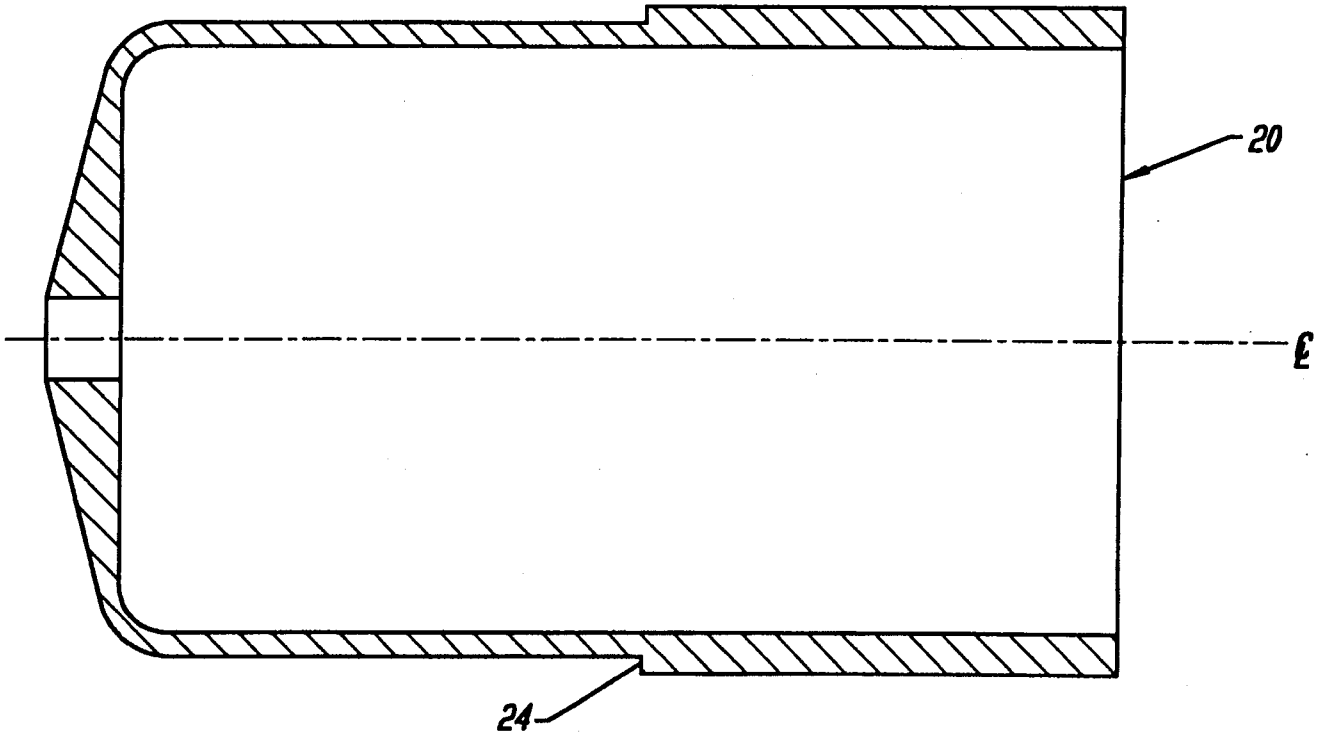
FIG. 4 is a sectional view of the filament-wound tube holder.
Figure 9:
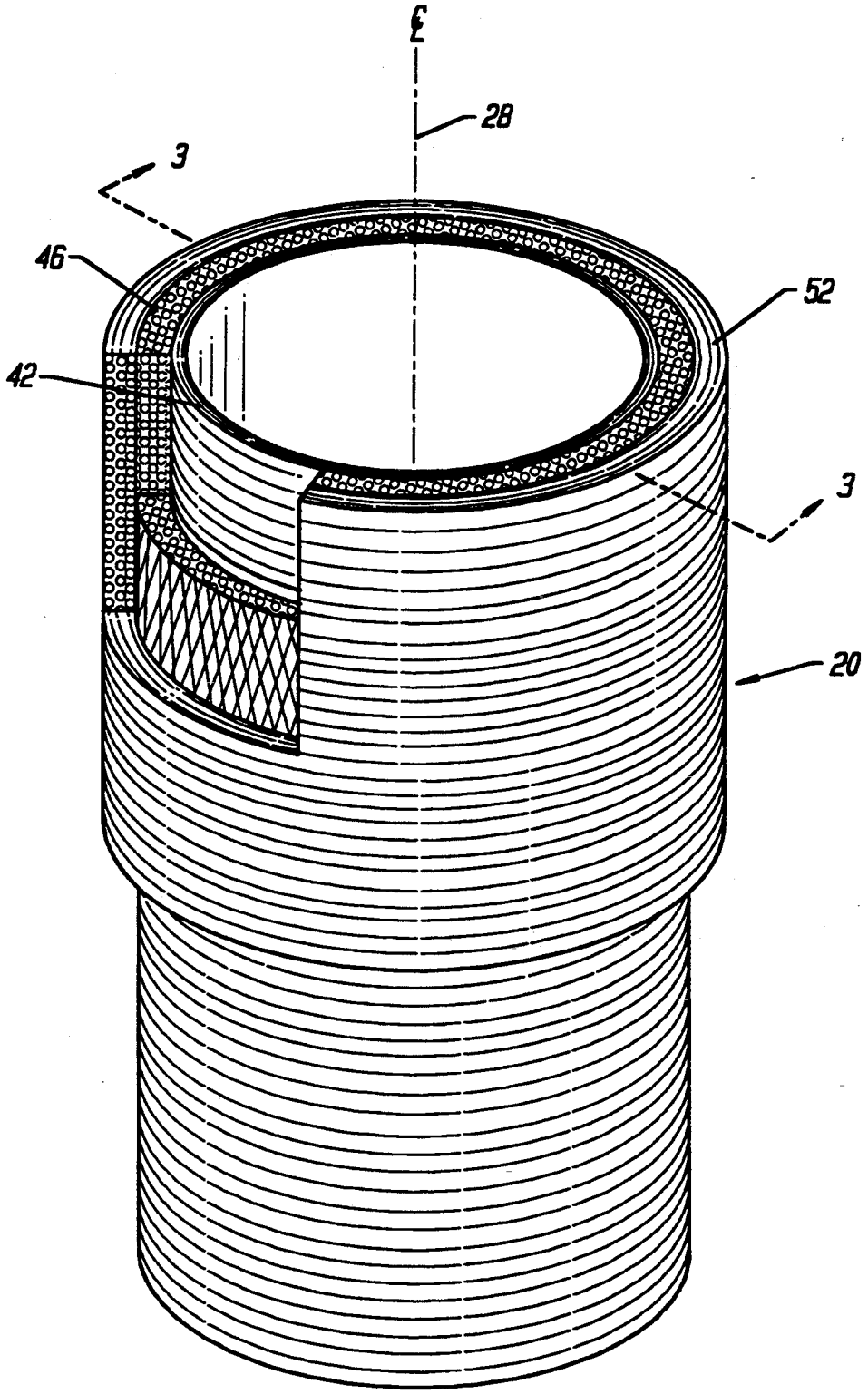
FIG. 9 is a perspective view of the filament-wound tube holder of FIG. 3.

FIGS. 3, 4, 5, and 9 illustrate the tube holder 20 utilized in the composite rotor 10. FIGS. 3 and 9 show the tube holder 20 after filament winding by the apparatus of FIG. 5. FIG. 4 shows the tube holder 20 after machining prior to insertion into the rotor plate 12.

Figure 5:
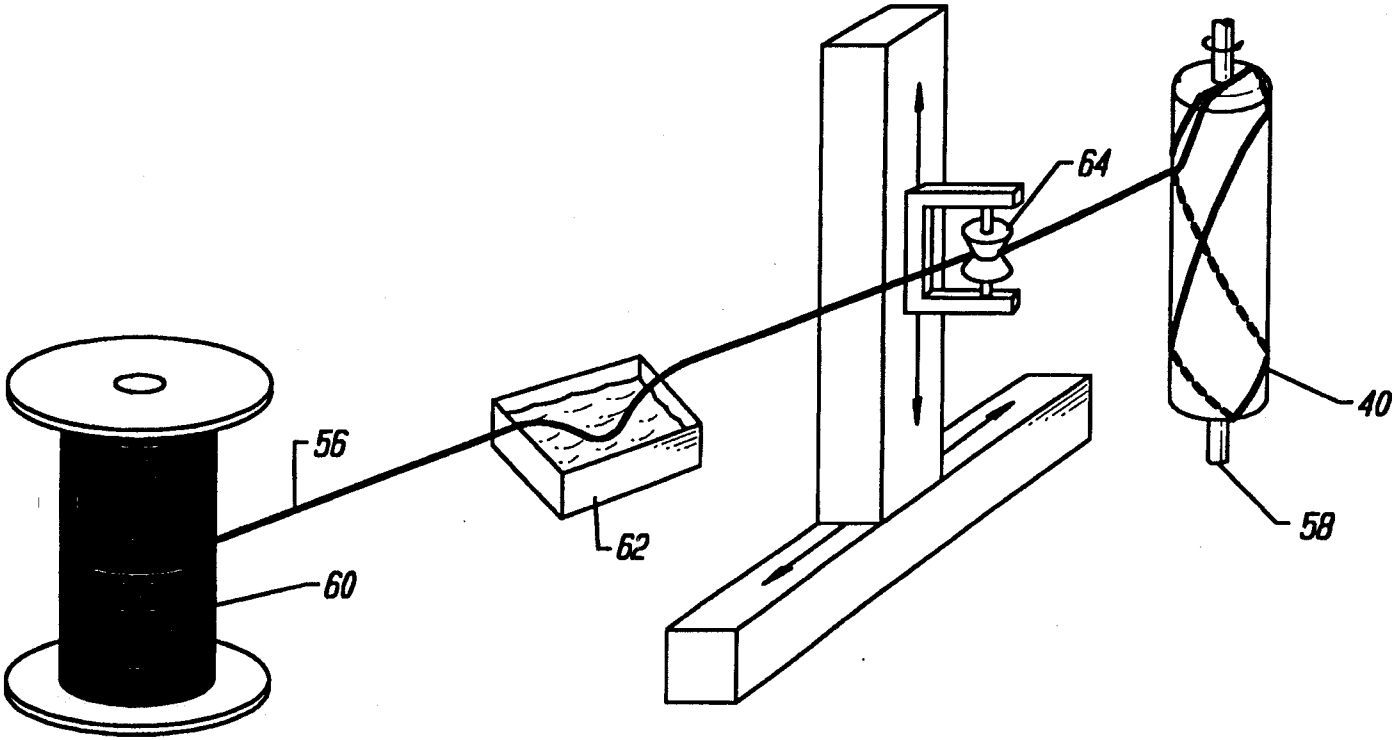
FIG. 5 is a perspective view of the filament-wound tube holder of FIG. 3 and equipment used in its fabrication.

The tube holders 20 are fabricated by helically and circumferentially winding a continuous carbon filament dipped in resin over a cylindrical mandrel 40 (FIG. 5). The winding begins with a inner circumferential layer 42 (FIG. 3) wound onto the cylindrical mandrel 40. Toward the middle of the mandrel, the inner circumferential layer is increased in thickness at 44 to create a larger diameter.

Next, a helical layer 46 of filament is wound onto the mandrel on top of the inner circumferential layer 42 and at the ends of the mandrel. The helical layer 46 reinforces the entire tube holder 20 along its axis 28. In the area 48 where the helical layer 46 overlaps the thicker inner circumferential layer 44 the fibers are oriented at an angle 50 with respect to the axis 28. The angled portion 48 of the helical winding places the fibers partially transverse to the axis in area where the flange seat 24 will be machined. The tube holder 20 is thus reinforced in the in-plane shear direction at the flange area where a downward centrifugal load acts on it.

An outer circumferential winding layer 52 is placed over the helical winding layer 46. The outer layer 52 has a uniform thickness except for an increased thickness area 54 at the flange location in the midsection. After winding, the wound shell is cured and cut into two halves no obtain two filament wound tube holders 20. Then the outside of the tube holder is machined to form the flange 24, as shown in FIG. 4. Thereafter, the flanged tube holders are bonded to the counterbored through holes 18 of the laminated rotor plate 12 with a structural adhesive such as epoxy.

As shown in FIG. 5, the tube holders 20 are fabricated by circumferentially and helically winding a continuous filament of fibers coated with resin over the cylindrical mandrel 40. The apparatus illustrated in FIG. 5 is used to dip a carbon fiber filament 56 into resin and wind the carbon filament onto the outside of the mandrel 40. The mandrel 40 is rotated on a spindle 58. As the spindle 58 rotates, the filament 56 is wound onto the mandrel 40 in either a circumferential or helical pattern. The filament 56 is supplied by a spool 60 and is dipped in a resin bath 62. A computer controlled bobbin 64 moves in two orthogonal directions and guides the filament onto the surface of the rotating mandrel 40.

Figure 6:
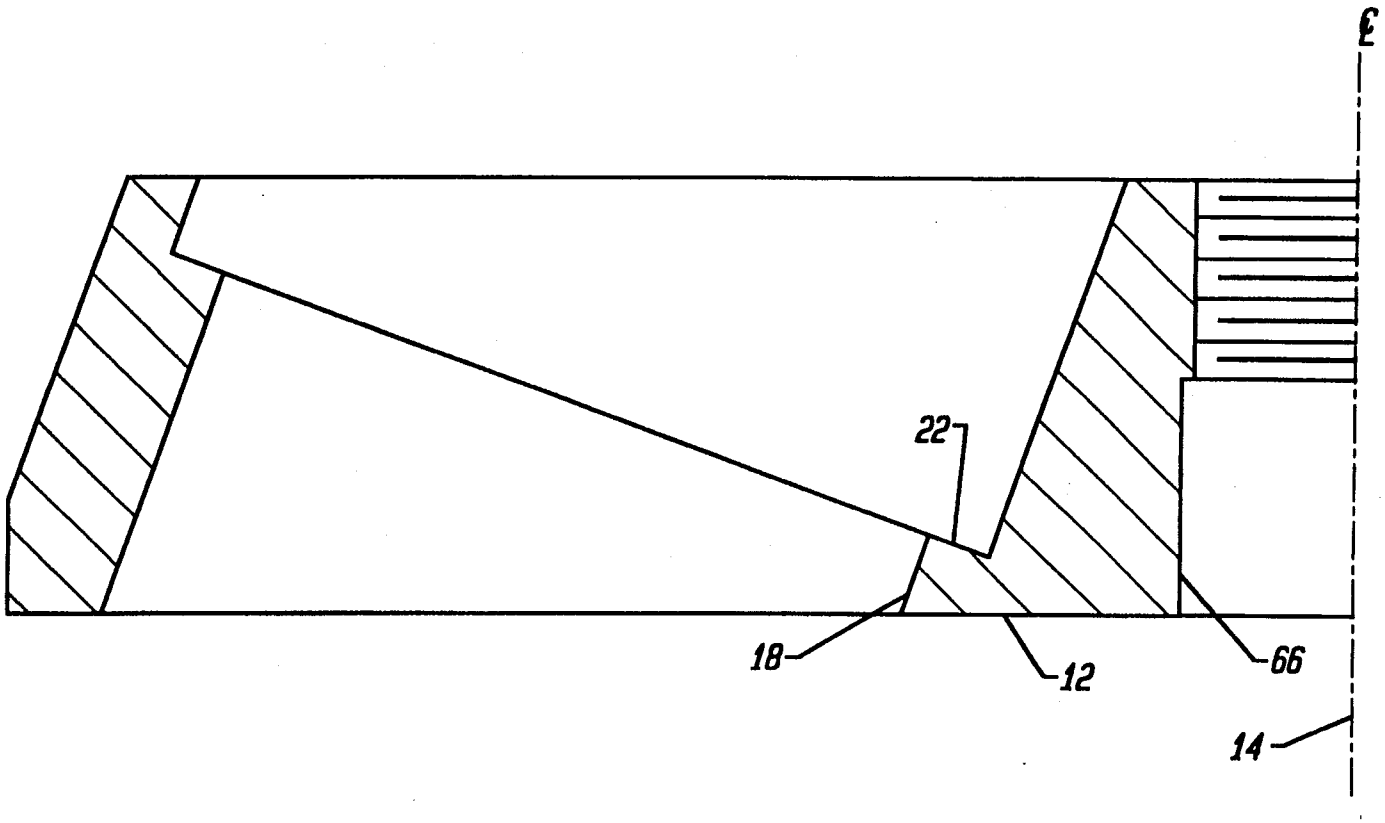
FIG. 6 is a section view of a rotor plate of the centrifuge rotor of FIG. 1.

The rotor plate 12 is fabricated by laminating several layers of unidirectional-carbon-fiber/epoxy-prepregnated tape oriented at right angles to the rotor axis. The tape is made of longitudinally continuous fiber and coated with epoxy resin. A typical tape is about 0.010 inch thick and contains about 65% fiber and 35% resin by weight. The tape is cut, indexed to a predetermined repeating angle, and stacked to the height of the rotor plate. The stack is then placed in a mold and cured under pressure at elevated temperatures to obtain a solid billet. Then, as shown in FIG. 6, the billet is machined to the shape of a rotor plate 12 with an axis 14 at right angles to the plane of the tape layers. An axial hole 66 is bored and threaded to receive the hub 16, and the through holes 18 are counterbored to form the annular step 22.

Figure 7:
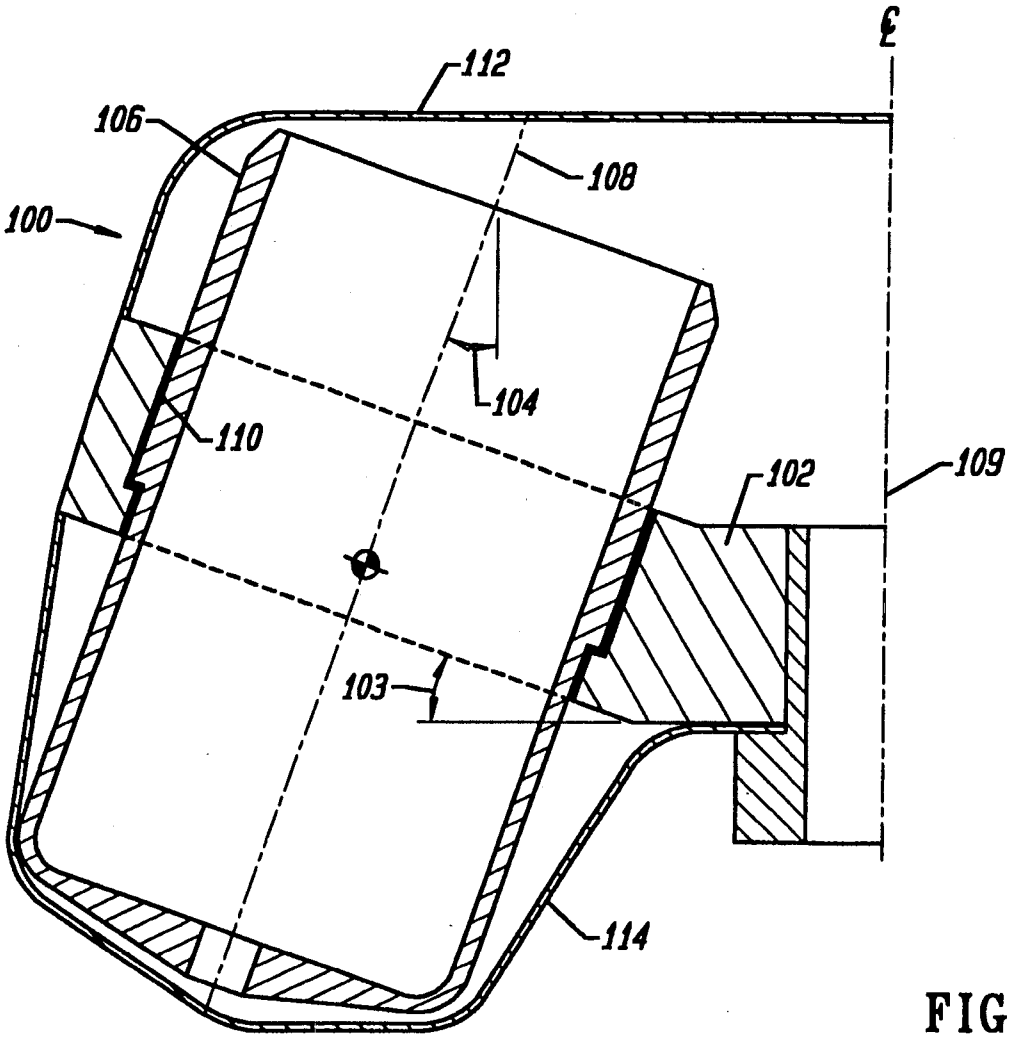
FIG. 7 is a sectional view of a fixed-angle centrifuge rotor of the present invention illustrating another embodiment of the invention, which orients the radially-outer portions of the rotor plate at an angle to the rotor axis.

An alternative rotor 100 of the present invention is illustrated in FIG. 7 in which a rotor plate 102 is formed into a conical section at an angle 103 that matches the angle 104 between the axis 108 of the tube holders and the rotor axis 109. The fibers in rotor plate 102 are parallel to the upper and lower surfaces of the rotor plate. The rotor plate is fabricated as described above with several laminated layers of fibers, but during curing the layers are formed into the conical shape. After curing, through holes 110 are counterbored into the rotor plate 102 and the tube holders 106 are bonded in place. Top and bottom covers 112 and 114 are added.

An advantage of the conical rotor plate 102 over the flat rotor plate 12 is that the conical plate can be thinner and still accommodate the angled counterbore. This reduces the weight and inertia of the rotor.

Figure 8:
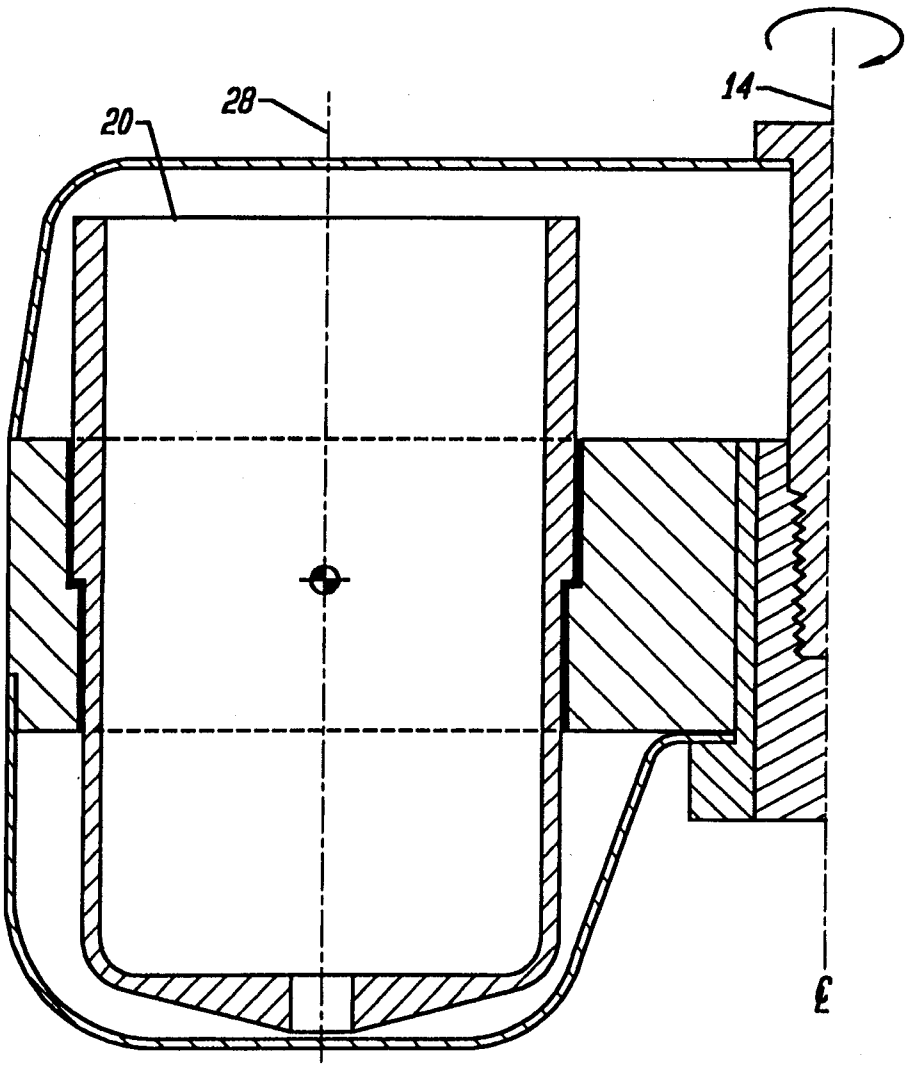
FIG. 8 is a sectional view of a centrifuge having vertically oriented tube holders.

From the above description, it will be apparent that the invention disclosed herein provides a novel and advantageous centrifuge rotor fabricated from fiber-reinforced composite material. The foregoing discussion discloses and describes merely exemplary embodiments of the present invention. As will be understood by those familiar with the art, the invention may be embodied in other specific forms without departing from the spirit or essential characteristics thereof. For example, the tube holders 20 can be oriented with their axes 28 parallel to the rotor axis 14 to form a vertical tube rotor, as illustrated in FIG. 8.

Accordingly, the disclosure of the present invention is intended to be illustrative, but not limiting, of the scope of the invention, which is set forth in the following claims.

What is claimed is:

1. A centrifuge rotor having a vertical axis of rotation and comprising:

a single rotor plate composed of fiber-reinforced composite material, the rotor plate including at least two counterbored through holes with each counterbore defining an annular step;

means for attaching the rotor plate to a spindle of a centrifuge; and tube holders mounted to the rotor plate in the counterbored through holes, wherein each tube holder is cylindrical in shape and is composed of fiber-reinforced composite material, wherein each tube holder has a circumferential flange that mates with and is bonded to the annular step in one of the counterbores of the rotor plate, wherein each tube holder has an open top for receiving a sample tube and a bottom for supporting the sample tube, wherein the top and bottom of each tube holder extend outward on opposite sides of the rotor plate, wherein the height of the rotor plate is less than the height of the tube holders, and wherein the center of mass of the tube holders is vertically positioned within the height of the rotor plate.

2. A centrifuge rotor as recited in claim 1 wherein the rotor plate is disposed in a plane normal to the rotor axis of rotation and is composed of multiple layers of fibers bound together with resin with the layers of fibers oriented normal to the rotor axis of rotation.

3. A centrifuge rotor as recited in claim 2 wherein each through hole in the rotor plate has an axis parallel to the rotor axis of rotation.

4. A centrifuge rotor as recited in claim 2 wherein each through hole in the rotor plate has an axis tilted toward the rotor axis of rotation.

5. A centrifuge rotor as recited in claim 1 wherein the height of the rotor plate is about one-third of the height of the tube holders.

6. A centrifuge rotor as recited in claim 1 wherein the rotor further comprises a top cover enclosing the top of the rotor plate and the tops of the tube holders.

7. A centrifuge rotor as recited in claim 1 wherein the rotor further comprises a bottom cover enclosing the bottom of the rotor plate and the bottoms of the tube holders.

8. A centrifuge rotor having a vertical axis of rotation and comprising:

a laminated rotor plate disposed in a plane normal to the rotor axis of rotation and composed of fiber-reinforced composite material, the fibers thereof oriented in multiple layers disposed normal to the rotor axis of rotation and bound together with resin, the laminated rotor plate including two or more counterbored through holes with each counterbore defining an annular step;

means for attaching the rotor plate to a spindle of a centrifuge;

tube holders mounted to the laminated rotor plate in the counterbored through holes, wherein each tube holder is cylindrical in shape and is composed of multiple layers of fiber-reinforced composite material, wherein each tube holder has a circumferential flange that mates with and is bonded to the annular step in one of the counterbores of the laminated rotor plate, and wherein each tube holder has an open top for receiving a sample tube and a bottom for supporting the sample tube, wherein the center of mass of the tube holders is vertically positioned within the height of the laminated rotor plate;

a top cover enclosing the top of the laminated rotor plate and the tops of the tube holders; and a bottom cover enclosing the bottom of the laminated rotor plate and the bottoms of the tube holders.

9. A centrifuge rotor comprising:

a single rotor plate composed of fiber-reinforced composite material, the rotor plate including at least two counterbored through holes with each counterbore defining an annular step;

means for attaching the rotor plate to a spindle of a centrifuge; and tube holders mounted to the rotor plate in the counterbored through holes, wherein each tube holder is cylindrical in shape and is composed of three layers of filament-wound fiber-reinforced composite material with filaments in an inner layer and an outer layer being oriented circumferentially with respect to an axis of the tube holder and filaments in an intermediate layer being oriented helically with respect to the axis of the tube holder, wherein each tube holder has a circumferential flange that mates with and is bonded to the annular step in one of the counterbores of the rotor plate, wherein each tube holder has an open top for receiving a sample tube and a bottom for supporting the sample tube, and wherein the top and bottom of each tube holder extend outward on opposite sides of the rotor plate.

* * * * *